US006905313B2

(12) United States Patent
Sasa

(10) Patent No.: US 6,905,313 B2
(45) Date of Patent: Jun. 14, 2005

(54) PRESSURE PRODUCTION UNIT AND INK JET PRINTER USING THE SAME

(75) Inventor: Masahiko Sasa, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 62 days.

(21) Appl. No.: 10/626,702

(22) Filed: Jul. 25, 2003

(65) Prior Publication Data

US 2004/0212655 A1 Oct. 28, 2004

(30) Foreign Application Priority Data

Jul. 26, 2002 (JP) ..... 2002-218192
Mar. 25, 2003 (JP) ..... 2003-082799

(51) Int. Cl.[7] ..... F04B 49/10; B41J 29/293
(52) U.S. Cl. ..... 417/32; 347/19
(58) Field of Search ..... 417/32, 44.1; 347/19, 347/85

(56) References Cited

U.S. PATENT DOCUMENTS 4,986,738 A * 1/1991 Kawasaki et al. ..... 417/304
6,290,343 B1 9/2001 Lewis et al.

FOREIGN PATENT DOCUMENTS

| | | |
|---|---|---|
| JP | AY2 57-36432 | 8/1982 |
| JP | 59-145155 | 8/1984 |
| JP | B2 2703647 | 10/1997 |
| JP | A10-138506 | 5/1998 |

* cited by examiner

*Primary Examiner*—Shih-Wen Hsieh
(74) *Attorney, Agent, or Firm*—Oliff & Berridge, PLC

(57) ABSTRACT

A pressure production unit provided in an ink jet printer. The pressure production unit includes: an air pump unit; a drive source that drives the air pump unit; a storage unit; a temperature sensing unit; and a control unit. The storage unit stores a first correlation characteristic indicating correlation between a drive frequency of the drive source and the air pressure of pressurized air produced in the air pump unit, and the first ambient temperature indicating an ambient temperature of the air pump unit when the first correlation characteristic is acquired. The control unit corrects the first correlation characteristic according to the first ambient temperature and the second ambient temperature sensed by the temperature sensing unit, and controls the drive source on the basis of the corrected first correlation characteristic so that a predetermined air pressure is produced.

20 Claims, 14 Drawing Sheets

PRESSURE PRODUCTION UNIT AND INK JET PRINTER USING THE SAME

BACKGROUND OF THE INVENTION

1. Field of the Invention

This invention relates to a pressure production unit, an ink jet printer installing the pressure production unit, and a control method for an air pump drive source in the pressure production unit. In particular, the invention relates to an art for making it possible to eliminate air pressure variations based on manufacturing errors of an orifice and an air pump in a pressurized air supply system.

2. Background Art

Hitherto, various ink jet printers capable of printing text and images in ink of multiplex colors supplied from ink cartridges of multiple colors have been put to practical use. A recent ink cartridge has been configured as follows: Ink in a bag formed of a thin film is stored in an ink storage chamber. An air chamber is formed in a space outside the bag. When wiping nozzles by a wiper, positive pressure can be made to act on ink through the thin film by pressurized air supplied to the air chamber. The air supply system includes an air pump, a drive motor for driving the air pump, an air tube extending from the air pump, a plurality of branch passages from the air tube to a plurality of ink cartridges, a pressure regulator or a relief valve for pressure regulation connected to the air tube in the vicinity of the air pump, or an orifice, and the like.

For example, in an ink jet printer disclosed in Japanese Patent No. 2703647, an air supply system similar to that described above is provided. The air supply system includes a relief valve for pressure regulation, an outside-air temperature sensor for detecting an outside-air temperature, a pressure sensor for detecting the pressure of pressurized air in an air tube, and the like. To produce pressurized air before or after use of the printer, the drive voltage for driving a pump drive motor is corrected in response to the outside-air temperature detected by the outside-air temperature sensor.

In an ink jet record apparatus disclosed in JP-A-10-138506, an air supply system similar to that described above is provided. The air supply system includes a pressure regulator and a plurality of change-over valves placed in a plurality of branch passages. In an apparatus disclosed in U.S. Pat. No. 6,290,343, an air supply system similar to that described above is provided and includes a pressure relief valve and a pressure sensor.

Generally, to wipe the print head face by a wiper in an ink jet printer, it is common operation to wipe the print head face in a state in which pressure is added to ink by pressurized air and the ink is swollen from the tip face of nozzles to the outside. Incomplete wiping of the print head face will result in degradation of the print quality. To wipe the print head face, if the air pressure of the pressurized air is too high, ink leaks wastefully from the nozzles. On the other hand, if the air pressure is too low, the ink is little swollen from the tip face of the nozzles to the outside and thus ink droplets of different colors, foreign substances, etc., deposited on the nozzle tips cannot completely be wiped, thus adversely affecting the next printing.

To provide the air supply system of the ink jet printer described above with an orifice and regulate the air pressure through the orifice, the correlation characteristic between the orifice inner diameter and the air pressure in the number of revolutions of operation of one air pump is as shown in FIG. 15. As seen in FIG. 15, the smaller the diameter of the orifice, the higher the air pressure; in the orifice of a small diameter of about 0.5 mmϕ or less, the change width of the air pressure relative to change in the diameter is very large. Thus, a manufacturing error of each orifice has a considerable effect on the air pressure. Moreover, manufacturing errors of each air pump and each drive motor also occur and have an effect on the air pressure of pressurized air supplied from the air pump.

In printers in related arts, to set the control characteristics of an air pump drive motor, characteristic data of one, two, or three representative pressurized air production modules (air pump, drive motor, regulator or relief valve, etc.,) is acquired by experiment, and the control characteristics of all printers of the same model are determined based on the characteristic data. In this method, however, the effect of variations caused by manufacturing errors of the pressurized air production modules cannot be added.

Japanese Patent No. 2703647 discloses technical philosophy of making a temperature correction because the air pressure of pressurized air changes depending on the outside-air temperature, but does not disclose any measures against variations caused by manufacturing errors of the pressurized air production modules.

On the other hand, to adopt a diaphragm air pump as an air pump, a mechanism for transferring rotation of a drive motor to the diaphragm through an eccentric cam is adopted, but vibration sound produced by vibration of the diaphragm which reciprocates also causes noise at the printing time.

SUMMARY OF THE INVENTION

It is an object of the invention to provide an air pump drive source control technology capable of controlling air pressure in such a manner that the effect of manufacturing errors of pressurized air production modules is added.

Another object of the invention is to provide an air pump drive source control technology capable of controlling air pressure in such a manner that the effect of the outside-air temperature at the printing time is added.

Another object of the invention is to provide an air pump drive source control art capable of remarkably decreasing noise produced from a pressurized air production module.

To achieve the objects, the invention provides a pressure production unit, including: an air pump unit that produces pressurized air; a drive source that drives the air pump unit; a storage unit that stores a first correlation characteristic and a first ambient temperature, the first correlation characteristic indicating correlation between a drive frequency of the drive source and the air pressure of pressurized air produced in the air pump unit, the first ambient temperature indicating an ambient temperature of the air pump unit when the first correlation characteristic is acquired; a temperature sensing unit that senses ambient temperature of the air pump unit; and a control unit configured to set the ambient temperature sensed by the temperature sensing unit as a second ambient temperature, to make a correction to the first correlation characteristic according to the first and second ambient temperatures, and to control the drive source on the basis of the corrected first correlation characteristic so that a predetermined air pressure is produced.

The first correlation characteristic indicating the correlation between the drive frequency of the drive source and the air pressure of pressurized air produced in the air pump unit is acquired. The first correlation characteristic and the first ambient temperature of the air pump unit, sensed when the first correlation characteristic is acquired, are previously stored in the storage unit.

When the air pump unit is caused to produce pressurized air, the temperature sensing unit senses the ambient temperature of the air pump and the control unit sets this temperature as a second ambient temperature. The control unit makes a temperature correction to the first correlation characteristic stored in the storage unit based on the first ambient temperature and the second ambient temperature. Further, the control unit controls the drive source so that a predetermined air pressure is produced using the first correlation characteristic to which the temperature correction is made.

Thus, the first correlation characteristic reflecting the manufacturing errors of the air pump, the drive source, and an orifice and the air pump ambient temperature when the first correlation characteristic is acquired are previously acquired and stored in the storage unit. When pressurized air is produced by the air pump unit and the drive source, temperature correction is made to the first correlation characteristic based on the stored the first and second ambient temperatures. The drive source is controlled so that the predetermined air pressure is produced using the first correlation characteristic to which the temperature correction is made, so that an error of the air pressure caused by the manufacturing error of the air pump and the drive source can be decreased exceptionally.

For example, if an orifice is formed in the pressurized air supply channel in the air pump unit for supplying pressurized air, as the air pump ambient temperature (namely, outside-air temperature) becomes high, the viscosity of air increases and the air pressure adjusted in the orifice increases. Then, the temperature correction is made as described above, whereby the change in the air pressure caused by change in the outside-air temperature is corrected and an error of the air pressure when pressurized air having a predetermined air pressure is produced can be decreased exceptionally.

Preferably, the storage unit stores a second correlation characteristic indicating a correlation between duty ratio of a drive pulse for driving the drive source and drive frequency of the drive source. The control unit is configured to determine the drive frequency of the drive source on the basis of the corrected first correlation characteristic, and to determine the duty ratio according to the drive frequency of the drive source and the second correlation characteristic.

To control the drive source of a DC motor in a PWM (Pulse Width Modulation) manner, the duty ratio of the drive pulse and the drive frequency of the drive source have almost linear relationship, but the characteristic changes delicately for each drive source because of the drive source manufacturing error. Then, the second correlation characteristic indicating the correlation between the duty ratio of the drive pulse for driving the drive source and the drive frequency is acquired and is previously stored in the storage unit. The drive frequency of the drive source is determined based on the first correlation characteristic to which the temperature correction is made. The drive frequency and the second correlation characteristic are used to determine the duty ratio of the drive pulse. Accordingly, the accuracy of control of the drive frequency of the drive source can be enhanced and an error of the air pressure when pressurized air to a predetermined air pressure is produced can be decreased exceptionally.

The invention may provide an ink jet printer, including: an ink cartridge that stores ink; a record head which selectively ejects the ink supplied from the ink cartridge onto a record medium; an air pump unit that produces pressurized air to be supplied to the ink cartridge to pressure the ink; a drive source that drives the air pump unit; a storage unit that stores a first correlation characteristic and a first ambient temperature, the first correlation characteristic indicating correlation between a drive frequency of the drive source and the air pressure of pressurized air produced in the air pump unit, the first ambient temperature indicating an ambient temperature of the air pump unit when the first correlation characteristic is acquired; a temperature sensing unit that senses ambient temperature of the air pump unit; and a control unit configured to set the ambient temperature sensed by the temperature sensing unit as a second ambient temperature, to make a correction to the first correlation characteristic according to the first and second ambient temperatures, and to control the drive source on the basis of the corrected first correlation characteristic so that a predetermined air pressure is produced. Therefore, the air pressure can be controlled in such a manner that the effect of manufacturing errors of each air production unit is added. Further the air pressure can be controlled in such a manner that the effect of the outside-air temperature at the printing time is added.

The invention may provide a control method of a drive source for driving an air pump unit to produce pressurized air in a pressure production unit. The control method includes: finding a first correlation characteristic indicating correlation between a drive frequency of the drive source and the air pressure of pressurized air produced in the air pump unit; finding a first ambient temperature, the first ambient temperature indicating an ambient temperature of the pump unit when the first correlation characteristic is acquired; sensing a second ambient temperature, the second ambient temperature indicating a current ambient temperature of the pump unit; correcting the first correlation characteristic based on the first and second ambient temperatures; and controlling the drive source on the basis of the corrected first correlation characteristic so that a predetermined air pressure is produced.

First, the first correlation characteristic indicating the correlation between the drive frequency of the drive source and the air pressure of pressurized air produced in the air pump unit and the first ambient temperature are previously found. The first correlation characteristic includes an air pump manufacturing error and an orifice manufacturing error if an orifice for adjusting the air pressure produced in the air pump exists. The first ambient temperature represents the air pump ambient temperature when the first correlation characteristic is found.

Next, when pressurized air is produced at the use stage of the pressure production unit, a temperature correction is made to the first correlation characteristic based on the second ambient temperature sensed by a temperature sensor and the first ambient temperature. The drive source is controlled so that the predetermined air pressure is produced on the basis of the corrected first correlation characteristic.

Thus, the air pressure is controlled using the first correlation characteristic reflecting the manufacturing errors of each air pump, drive source, and the orifice, so that an error of the air pressure produced in the air pump can be decreased exceptionally.

As previously described, the temperature correction is made based on the first and second ambient temperatures at the use stage of the pressure production unit, whereby the change in the air pressure caused by change in the outside-air temperature is corrected and an error of the pressurized air can be decreased exceptionally.

The invention may provide a control method of a drive source for driving an air pump unit in an ink jet printer, wherein the ink jet printer includes an ink cartridge that stores ink, and a record head which selectively ejects the ink supplied from the ink cartridge onto a record medium; and the air pump unit produces pressurized air to pressure the ink in the ink cartridge. The control method includes: finding a first correlation characteristic indicating correlation between a drive frequency of the drive source and the air pressure of pressurized air produced in the air pump unit; finding a first ambient temperature, the first ambient temperature indicating an ambient temperature of the pump unit when the first correlation characteristic is acquired; sensing a second ambient temperature, the second ambient temperature indicating a current ambient temperature of the pump unit; correcting the first correlation characteristic based on the first and second ambient temperatures; and controlling the drive source so that a predetermined air pressure is produced on the basis of the corrected first correlation characteristic.

The invention may provide a pressure production unit, including: an air pump unit for producing pressurized air; a drive source for driving an air pump unit; storing means for storing a first correlation characteristic and a first ambient temperature, the first correlation characteristic indicating correlation between a drive frequency of the drive source and the air pressure of the pressurized air produced in the air pump unit, the first ambient temperature indicating an ambient temperature of the pump unit when the first correlation characteristic is acquired; sensing means for sensing a second ambient temperature, the second ambient temperature indicating a current ambient temperature of the pump unit; correcting means for correcting the first correlation characteristic based on the first and second ambient temperatures; and controlling means for controlling the drive source on the basis of the corrected first correlation characteristic so that a predetermined air pressure is produced.

BRIEF DESCRIPTION OF THE DRAWINGS

The present invention may be more readily described with reference to the accompanying drawings, in which:

FIG. 16A is a sectional view of the print mechanism section and FIG. 16B is a plan view of the print mechanism section.

DETAILED DESCRIPTION OF THE PREFERRED EMBODIMENTS

Referring now to the accompanying drawings, there is shown a preferred embodiment of the invention. The embodiment is provided by applying the invention to a multifunction apparatus having a printer function, a copy function, a scanner function, a facsimile function, and a telephone function.

Figure 1:
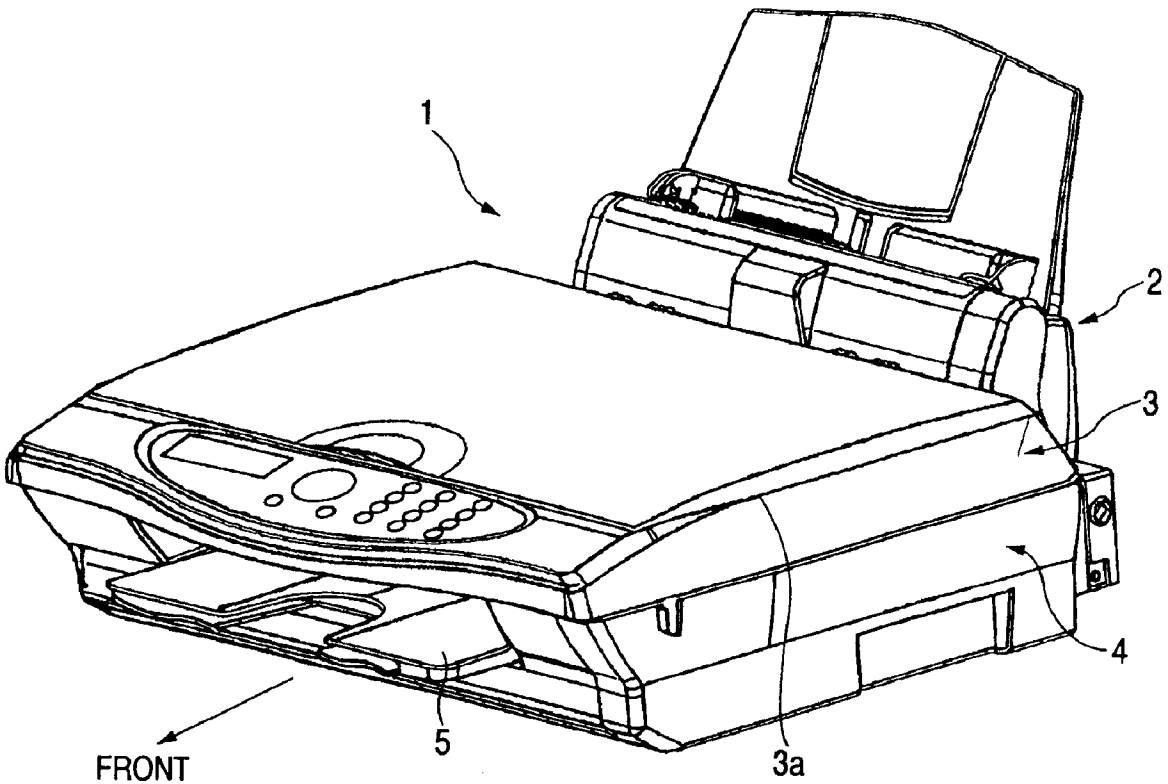
FIG. 1 is a perspective view of a multifunction apparatus according to an embodiment of the invention.

As shown in FIG. 1, a multifunction apparatus 1 has a paper feeder 2 in the rear end portion, an original reader 3 for the copy function and the facsimile function on the top in front of the paper feeder 2, and an ink jet printer 4 for providing the printer function in the whole below the original reader 3. A paper ejection table 5 of print paper is placed at the front of the ink jet printer 4.

Figure 2:
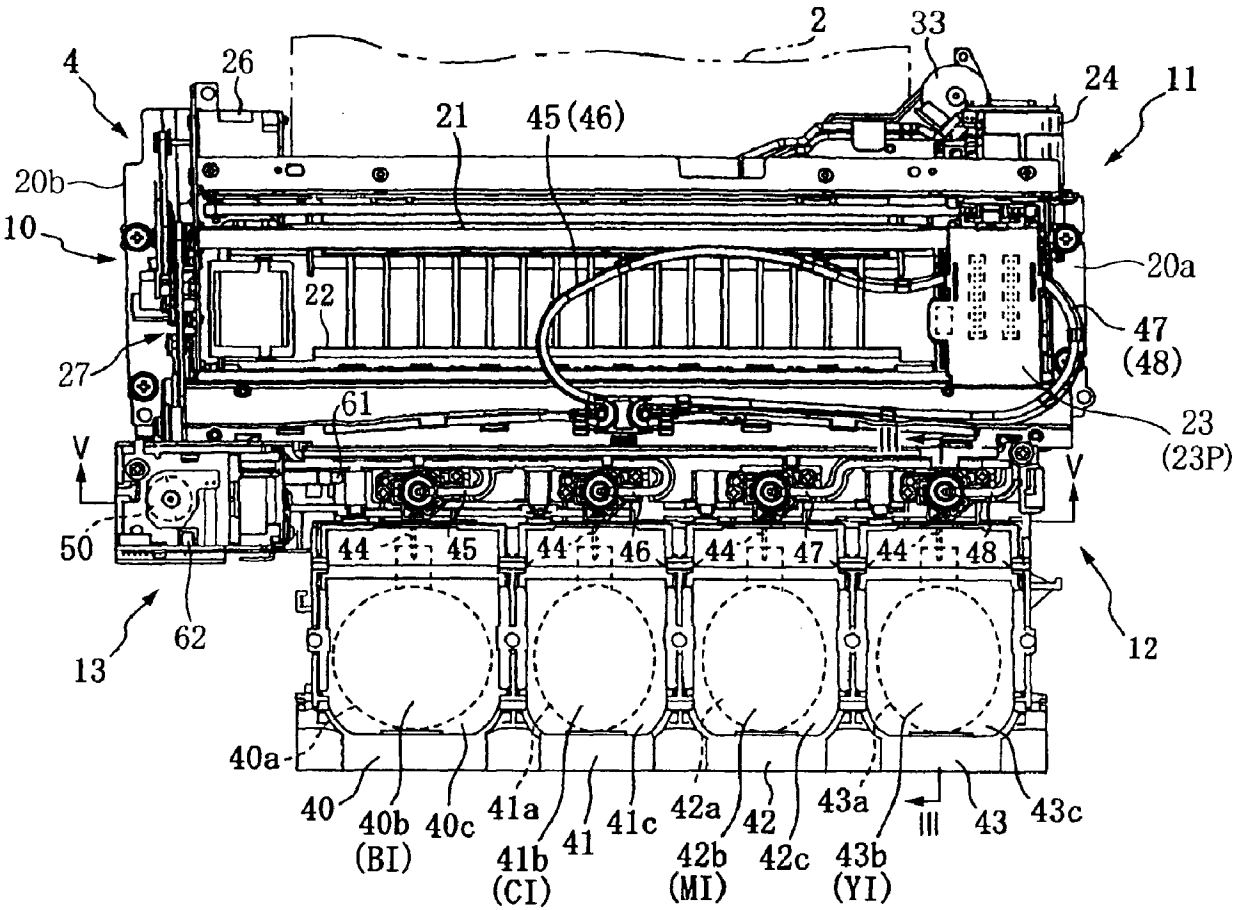
FIG. 2 is a plan view to show the internal mechanism of an ink jet printer.

The original reader 3 can be swung up and down by means of a horizontal shaft (not shown) in the rear end portion and when a top cover 3*a* is opened upward, placement glass for placing an original is placed and an image scanner for reading an original is below the placement glass. The operator opens the original reader 3 upward with his or her hand and replaces ink cartridges 40 to 43 in the ink jet printer 4 or maintains a print mechanism section 10. The ink jet printer 4 is placed in front of the paper feeder 2, as shown in FIG. 2.

Next, the ink jet printer 4 will be discussed.

The ink jet printer 4 is made up of the print mechanism section 10 for printing on paper (for example, A4-size or letter-size paper) supplied from the paper feeder 2 through a print head 23P, a maintenance mechanism section 11 for performing maintenance processing of the print head 23P, an ink supply section 12 for supplying ink from the ink cartridges 40 to 43 to the print mechanism section 10, a pressurized air supply section 13 for supplying pressurized air to the ink cartridges 40 to 43, and the like, as shown in FIGS. 2 to 5.

To begin with, the print mechanism section 10 will be discussed.

Figure 4:
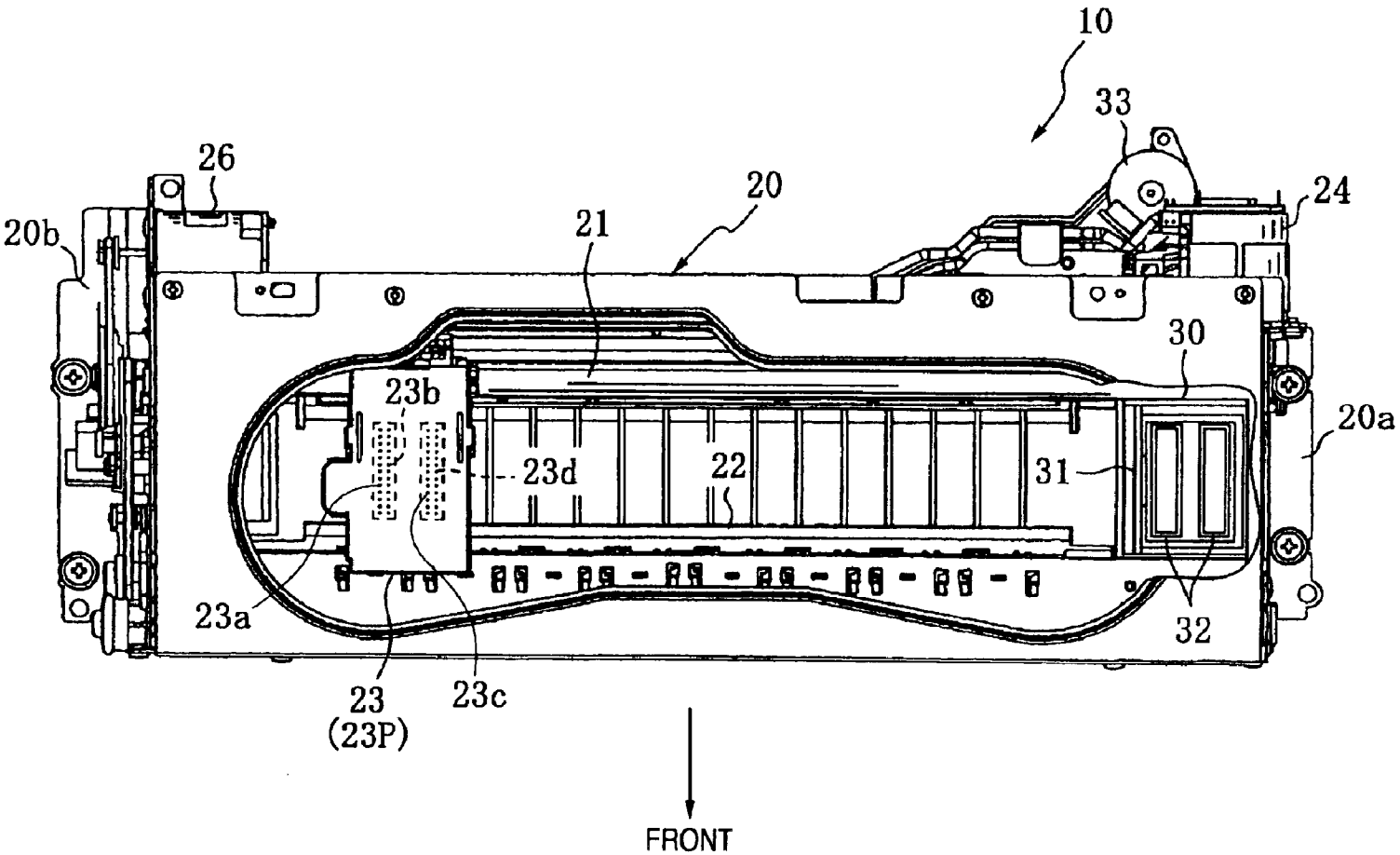
FIG. 4 is a plan view of the print mechanism section.

The print mechanism section 10 is housed in a print unit frame 20 shaped like a flat box containing a reinforcing top plate formed with an opening for enabling paper to be accessed, as shown in FIGS. 2 and 4. A rear guide shaft 21 and a front guide rail 22 in the frame 20 are fixed at left and right end parts to a right side wall 20*a* and a left side wall 20*b*. A carriage 23 and the print head 23P are guided and supported movably from side to side on the guide shaft 21 and the guide rail 22. The carriage 23 and the print head 23P are driven by a carriage drive motor 24 via a timing belt so that they can be reciprocated from side to side along the guide shaft 21 and the guide rail 22. The print head 23P is joined and fixed to the front of the carriage 23. The carriage 23 is guided by the guide shaft 21. The print head 23P is guided by the guide rail 22.

As shown in FIGS. 2 and 4, the print head 23P is formed on the lower face with four ink jet nozzle rows 23*a* to 23*d* corresponding to four ink colors, and each nozzle row is formed with a large number of ink jet nozzles 23*n* (see FIG. 7). The black and cyan nozzle rows 23*a* and 23*b* are close to each other and the magenta and yellow nozzle rows 23*c* and 23*d* are close to each other. Each ink jet nozzle is driven by a piezoelectric element actuator for jetting an ink droplet. The print head 23P may be a print head of a heat generation element drive method.

A main transport roller (registration roller) 25 (see FIG. 3) is disposed below the guide shaft 21. The main transport roller 25 is rotatably supported and is rotated in a predetermined rotation direction through a gear mechanism 27 by a paper delivery motor 26 for transporting paper fed from the paper feeder 2 in an ahead paper feed direction and ejecting the paper to the paper ejection table 5 while moving the paper just below the print head 23P roughly horizontally.

Next, the maintenance mechanism section 11 will be discussed briefly.

As shown in FIG. 4, a wiper blade 31 made of thin rubber is disposed upright in a maintenance case 30 in the vicinity of the bottom in the right end part in the print unit frame 20. A pair of rubber head caps 32 is disposed upward on the right of the wiper blade 31. The wiper blade 31 is moved up and down through a blade hoisting and lowering mechanism with forward rotation of a maintenance motor 33 attached to the rear end of the maintenance case 30. The head cap 32 is moved up and down through a cap hoisting and lowering mechanism with reverse rotation of the maintenance motor 33.

Next, the ink supply section 12 will be discussed.

Figure 3:
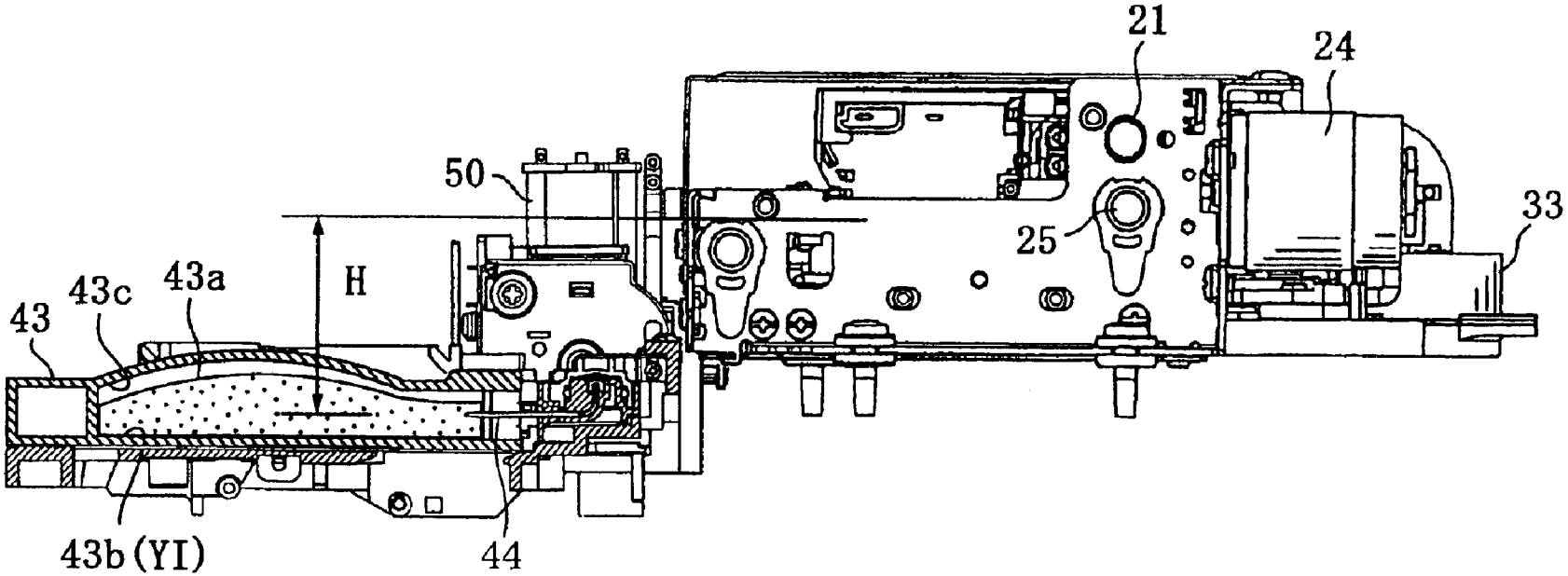
FIG. 3 is a side view of a print mechanism section containing a sectional view taken on line III—III in FIG. 2.

The black ink cartridge 40, the cyan ink cartridge 41, the magenta ink cartridge 42, and the yellow ink cartridge 43 are disposed in order from left to right at the front of the ink supply section 12. As shown in FIG. 3, in the ink cartridges 40 to 43, flexible film members 40*a* to 43*a* are put on roughly all areas of the insides of cartridge cases for separating lower ink storage chambers 40*b* to 43*b* and upper air chambers 40*c* to 43*c*. Ink is stored in the ink storage chambers 40*b* to 43*b* and the atmosphere flows into the air chambers 40*c* to 43*c*. Black ink BI, cyan ink CI, magenta ink MI, and yellow ink YI are stored in the ink storage chambers 40*b* to 43*b* of the ink cartridges 40 to 43.

Figure 5:
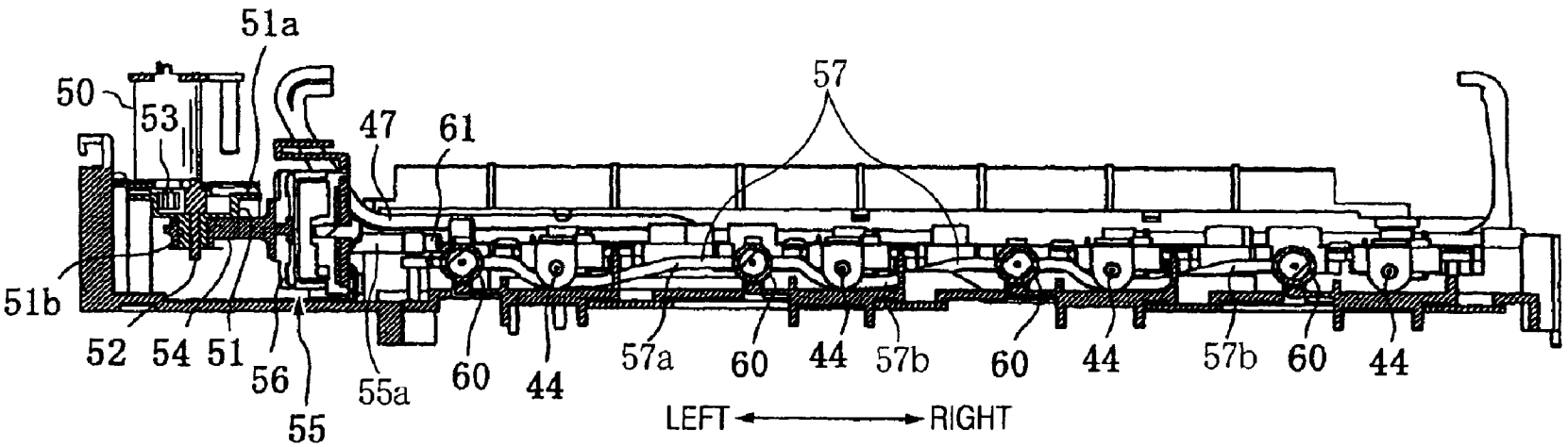
FIG. 5 is a sectional view taken on line V—V in FIG. 2.

As shown in FIGS. 2, 3, and 5, an ink needle 44 is provided like forward projection at the depth of the placement section for placing each of the ink cartridges 40 to 43. The base end parts of the ink needles 44 are connected via corresponding dedicated ink supply tubes 45 to 48 to the print head 23P. The ink supply tubes 45 and 46 are bundled so that they overlap up and down from midpoints. The ink supply tubes 47 and 48 are also bundled so that they overlap up and down from midpoints.

Figure 7A:
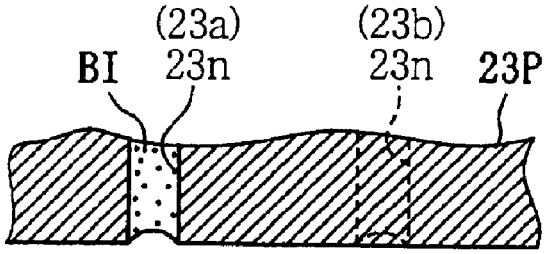
FIG. 7A is a sectional view of nozzles in a printable state without supplying pressurized air.

As shown in FIG. 3, the print head 23P is disposed at a position higher than the ink cartridges 40 to 43 by head (height difference) H. When the ink cartridges 40 to 43 are placed in the predetermined placement sections, the tips of the ink needles 44 pass through the rear end parts of the film members 40*a* to 43*a* and arrive at the ink storage chambers 40*b* to 43*b*, so that ink BI, ink CI, ink MI, and ink YI in the ink storage chambers 40*b* to 43*b* are supplied via the dedicated ink supply tubes 45 to 48 to the print head 23P. The nozzles 23*n* of the nozzle rows 23*a* to 23*d* of the print head 23P are thus filled with ink BI, ink CI, ink MI, and ink YI supplied via the ink supply tubes 45 to 48. Since negative pressure is produced because of the head H, each nozzle 23*n* is formed with a regulated meniscus bent to the inside, as shown in FIG. 7A.

Next, the pressurized air supply section 13 will be discussed. The pressurized air supply section 13 implements a pressure production unit.

AS shown in FIGS. 2 and 5, a drive motor 50 for driving an air pump 55 of a diaphragm pump is placed downward on the left of the ink cartridge 40 at the left end. An internal gear 51 with a bottom wall is supported by a pivot 52 for rotation below the drive motor 50. A pinion gear 53 of the drive shaft of the drive motor 50 meshes with the internal gear 51. An eccentric cam 51*b* is formed integrally on the bottom wall of the internal gear 51. The ratio between the number of teeth of the pinion gear 53 and the number of teeth of the internal gear 51 is 1:4. The left end part of a connection rod 54 is slidably outer-fitted into the eccentric cam 51*b*. The right end part of the connection rod 54 is joined to a diaphragm 56 of the air pump 55.

A collar part 51*a* having a slit is formed integrally in a part of the upper end of the internal gear 51. An encoder 62 made of a photointerrupter for detecting the collar part 51*a* is provided. Whenever the drive motor 50 makes four revolutions, the air pump 55 performs one reciprocation operation. Whenever the air pump 55 performs one reciprocation operation, the encoder 62 outputs one detection pulse signal to a controller 70. A thermistor 82 for detecting the ambient temperature of the air pump 55 is also provided.

Figure 6:
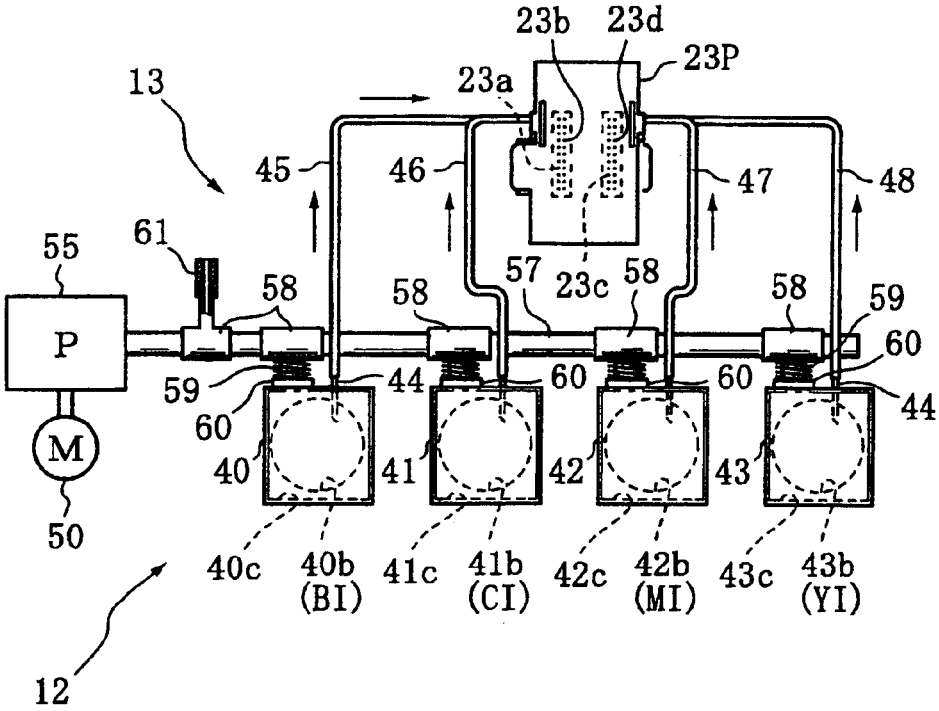
FIG. 6 is a schematic representation to describe an ink supply section and an air supply section.

The air pump 55 is provided with an exhaust valve and an intake valve. A flexible air supply tube. 57 (for example, having an inner diameter of 1 mm) is joined to an ejection tube 55*a* communicating with the exhaust valve. Four branch members 58 are attached to the air supply tube 57 at predetermined intervals. A pressure pad 60 elastically urged by a coil spring 59 is attached to a branch end part of each of the branch members 58, as shown in FIG. 6.

An orifice 61 is fixedly secured to ejection tube 55*a* of the air pump 55 through the branch member 58 and has a choke passage having a sufficiently smaller inner diameter (for example, about 0.5 mm) than the inner diameter of the air supply tube 57 and always communicates with the atmosphere through the choke passage. Therefore, when the ink cartridges 40 to 43 are placed in the predetermined placement sections, pressurized air supplied from the air pump 55 to the air supply tube 57 is supplied through the pressure pads 60 to the air chambers 40*c* to 43*c* of the ink cartridges 40 to 43. Incidentally, the orifice 61 may be formed integrally with the air pump 55 in such a manner that the ejection tube 55*a* communicating with the exhaust valve of air pump 55 is provided with the orifice 61.

The air supply tube 57 for connecting the branch members 58 is divided into an air supply tubes 57*a* and 57*b*. The air supply tube 57*a* connects the branch members 58 for branching air into the black ink cartridge and the cyan ink cartridge. The air supply tube 57*b* connects the ink cartridges from the air supply tube 57*a* onward. Since the black ink cartridge is wider than any other-ink cartridge, the air supply tube 57*a* is a little longer than the air supply tube 57*b*. Then, the air supply tube 57*a* is colored blue and the air supply tube 57*b* is colored white for preventing a mistake and intending efficient assembling.

Figure 9A:
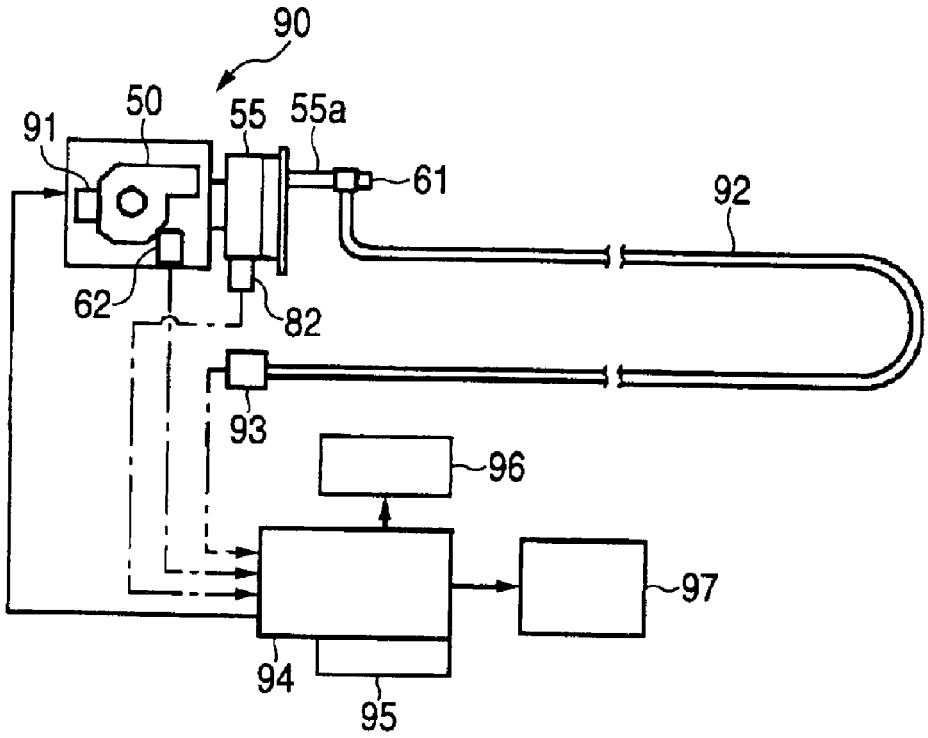
FIG. 9A is a diagram of a pump module and an inspection apparatus for inspecting the pump module.
Figure 9B:
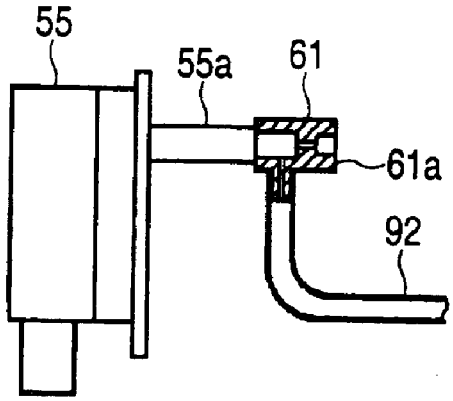
FIG. 9B is an enlarged sectional view of the main part of an air pump and an orifice.

When the air pump 55 does not operate, the atmosphere acts on the air chambers 40*c* to 43*c* through the air supply tube 57 and the orifice 61. When the drive motor 50 is driven at the maintenance processing time, the diaphragm 56 is reciprocated from side to side through the pinion gear 53, the internal gear 51, and the eccentric cam 51*b*. Thus, the air pump 55 is operated and produces pressurized air pressurized to about 95 mmAq, which then acts on the air chambers 40*c* to 43*c* of the ink cartridges 40 to 43. The pressurized air cancels the negative pressure produced because of the head H and ink is swollen from the tips of the nozzles (see FIGS. 7B to 7D). The pressurized air produced in the air pump 55 is exhausted from the orifice 61 and is subjected to pressure regulation and the air pressure in the air supply tube 57 becomes pressure responsive to the number of revolutions of the air and the outside-air temperature. As shown in FIG. 9B, the orifice 61 is a transverse hole and has an appentice part 61*a* and thus is resistant to dust and dirt at the working time.

Next, a control system of the multifunction apparatus 1 will be discussed.

Figure 8:
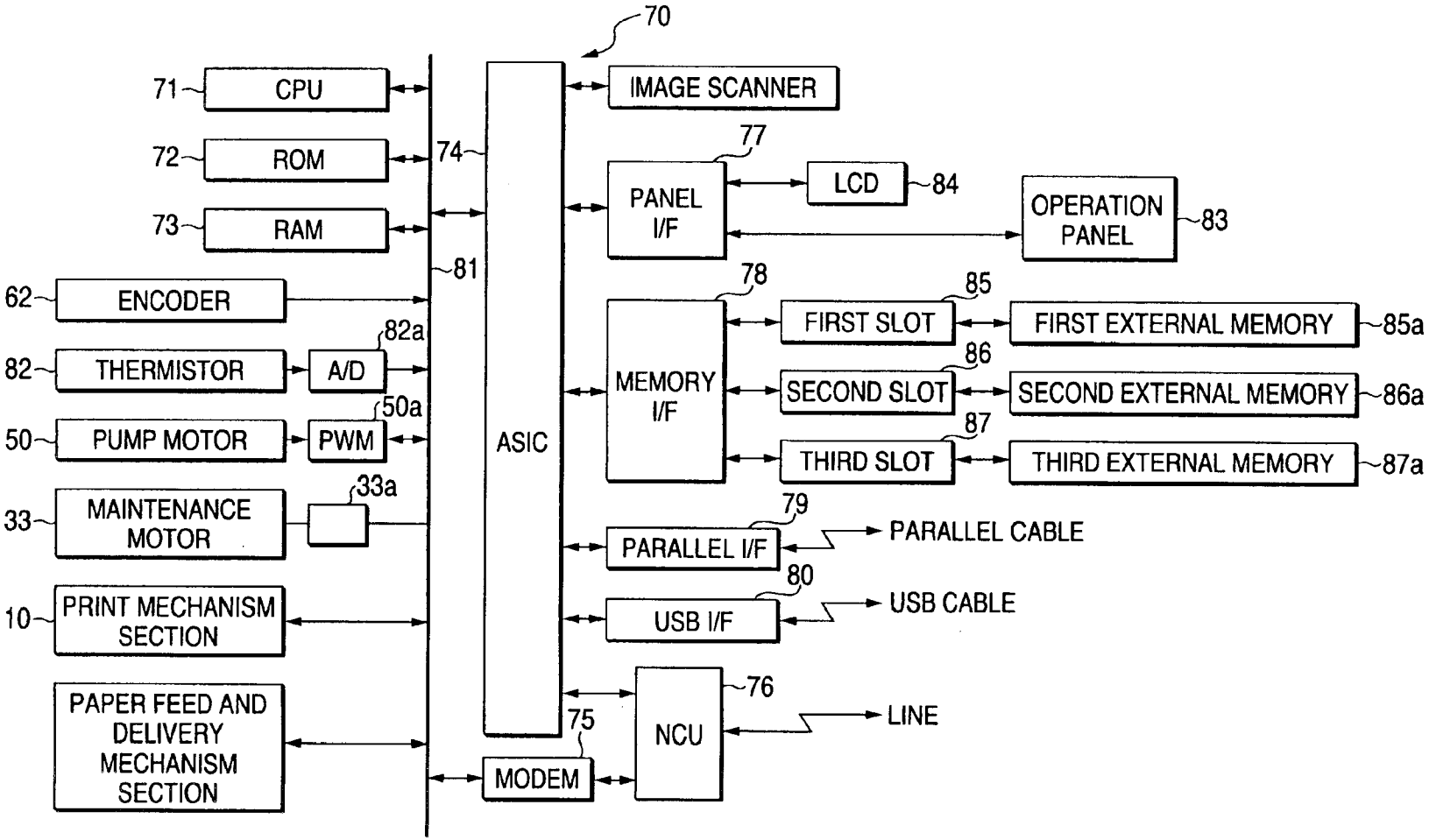
FIG. 8 is a block diagram of a control system of the multifunction apparatus according to the embodiment of the invention.

As shown in FIG. 8, the controller 70 of the multifunction apparatus 1 has a computer including a CPU (Central Processing Unit) 71, ROM (Read Only Memory) 72, and RAM (Random Access Memory) 73, an ASIC (application-specific integrated circuit) 74, a modem 75 and a network control unit (NCU) 76 for communicating with an external system over a telephone line, a panel interface 77, a memory interface 78, a parallel interface 79, a USB interface 80, a data transfer bus 81, etc., and is connected to the machines to be controlled as shown in the figure. The ROM 71 stores various control programs to accomplish the above-described functions of the multifunction apparatus 1. The RAM 72 retains stored information with backup of a secondary battery.

The maintenance motor 33 of the maintenance mechanism section 11 is connected to the bus 81 through the drive circuit 33*a*. The drive motor 50 (DC motor) of pressurized air production mechanism is connected to the bus 81 through a drive circuit 50*a* controlled in a PWM manner. The thermistor 82 for detecting the ambient temperature of the air pump 55 is connected to the bus 81 through an A/D converter 82*a*. An encoder 62 for detecting the reciprocation operation of the air pump 55 is connected to the bus 81.

An operation panel 83 of the multifunction apparatus 1 and an LCD (liquid crystal display) 84 are connected to the panel interface 77. First, second, and third slots 85, 86, and 87 are connected to the memory interface 78. First external memory to third external memory 85*a* to 87*a* implemented as compact flash (Registered trade mark), smart media (Registered trade mark), memory stick (Registered trade mark), etc., are detachably placed in the first, second, and third slots 85, 86, and 87. A parallel cable for data transmission and reception is connected to the parallel interface 79, and a USB cable for data transmission and reception is connected to the USB interface 80.

Next, the operation of the maintenance mechanism section 11 of the ink jet printer 4 for wiping the print head 23P is as follows: When the four ink cartridges 40 to 43 are placed at the predetermined positions shown in FIG. 2, the tips of the ink needles 44 pass through the rear end parts of the film members 40*a* to 43*a* and arrive at the ink storage chambers 40*b* to 43*b*, so that ink BI, ink CI, ink MI, and ink YI in the ink storage chambers 40*b* to 43*b* are supplied via the dedicated ink supply tubes 45 to 48 to the print head 23P. Then, the nozzles 23*n* of the nozzle rows 23*a* to 23*d* of the print head 23P are filled with ink BI, ink CI, ink MI, and ink YI.

Figure 7B:
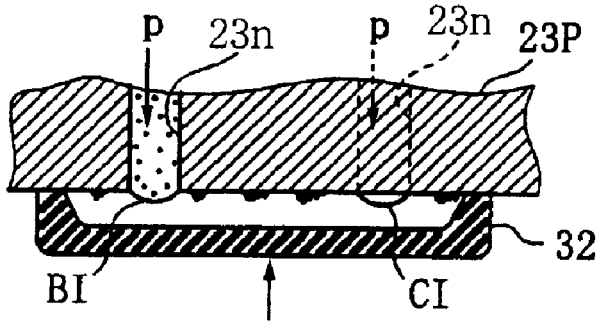
FIG. 7B is a sectional view of the nozzles and a head cap when pressurized air is made to act on the nozzles and the head cap is operated for performing pressurization purge.

As negative pressure is produced because of the head H, each nozzle 23*n* is formed at the tip with a meniscus bent to the inside, appropriate for printing, as shown in FIG. 7A. FIGS. 7A to 7E show only one nozzle 23*n* in each of the nozzle rows 23*a* and 23*b*. To perform purge processing, the print head 23P is moved to the maintenance position shown in FIG. 2 and then the maintenance motor 33 is reversely rotated for moving up the head cap 32 to an action position and capping the print head 23P with the head cap 32 in an intimate contact manner, as shown in FIG. 7B. Next, in this state, the pump drive motor 50 is driven.

When the air pump 55 is driven, pressurized air p pressurized to a predetermined pressure (about 95 mmAq) from the air pump 55 acts on the air chambers 40*c* to 43*c* of the ink cartridges 40 to 43 via the air supply tube 57. Then, when a predetermined time (for example, about five seconds) has elapsed, air pressure P of the pressurized air acts on ink BI, ink CI, ink MI, and ink YI in the ink storage chambers 40*b* to 43*b* and ink is swollen from the tips of the nozzles 23*n* of the nozzle rows 23*a* to 23*d* (the pressurization purge processing is complete).

Figure 7C:
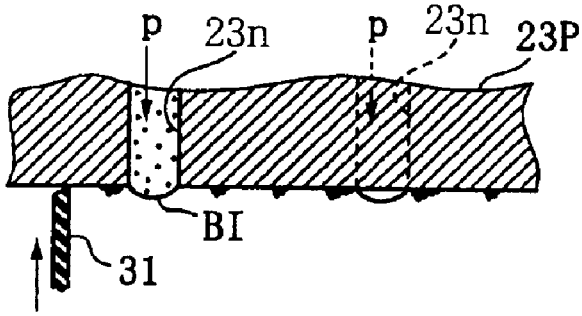
FIG. 7C is a sectional view of the nozzles and a blade when pressurized air is supplied to the nozzles and wiping of the blade is started.

The purge processing is thus complete and the pressure in the head cap 32 becomes non-negative pressure. Next, as shown in FIG. 7C, when a predetermined time has elapsed, the maintenance motor 33 is forward rotated for detaching the head cap 32 in intimate contact with the print head 23P therefrom and the wiper blade 31 is moved up to an action position.

Figure 7D:
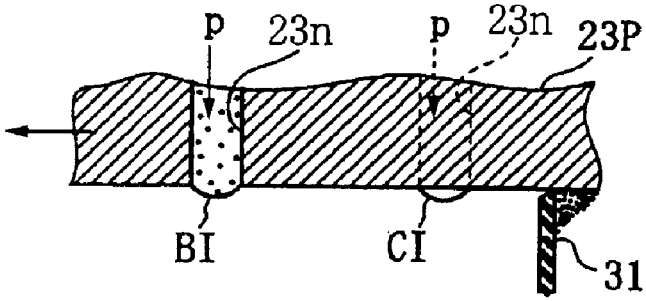
FIG. 7D is a sectional view of the nozzles and the blade when wiping of the blade is complete.

At this time, since the pressure in the head cap 32 is not negative pressure, air or ink of any other color deposited around each nozzle 23*n* is not mixed into the nozzle 23*n*. Accordingly, color mixing and missing color at the printing time can be prevented reliably. In this state, the print head 23P is moved to the left and the head face of the print head 23P is wiped by the wiper blade 31, as shown in FIG. 7D. Finally, the maintenance motor 33 is driven, the wiper blade 31 is moved down to the former standby position, and the pump motor 50 is stopped.

Figure 7E:
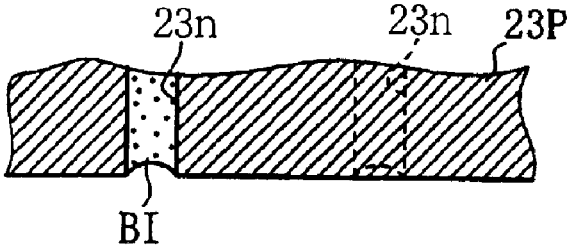
FIG. 7E is a sectional view of the nozzles when maintenance is complete.

When the head face is wiped by the wiper blade 31, the pressurized air also acts and therefore wiped ink does not enter any other nozzle 23*n* either. If the air pressure of the pressurized air acting on each nozzle 23*n* is canceled, each nozzle 23*n* is formed with a meniscus bent to the inside, appropriate for printing, as shown in FIG. 7E. After the maintenance processing is complete, print processing based on print data is executed and a color image is finely printed on paper fed from the paper feeder 2. Thus, when the maintenance processing is performed, the pressurization purge processing and wiping processing of the wiper blade 31 are performed in a state in which the air pressure P of the pressurized air produced in the air pump 55 is made to act on the nozzles 23*n*, so that color mixing and missing color can be prevented reliably at the printing time after the purge processing.

Next, one feature of the invention, a control method of the air pump drive motor 50 of the ink jet printer 4., namely, a control method of the air pump drive motor 50 of the pressurized air supply section 13 (pressure production unit) installed in the ink jet printer 4 will be discussed. First, the control method of the air pump drive motor 50 is outlined. In the first step, before the air pump 55 is assembled into the ink jet printer 4 (namely, before the air pump 55 is assembled into the pressurized air supply section 13 of the pressure production unit and further the multifunction apparatus 1), a first correlation characteristic indicating the correlation between the number of revolutions of the drive motor 50 (the drive frequency of the drive source) and the air pressure of the pressurized air produced in the air pump 55 and the air pump ambient temperature are previously found and a second correlation characteristic indicating the correlation between the duty ratio of drive pulses for driving the drive motor 50 and the number of revolutions of the drive motor 50 is also previously found. If the first correlation characteristic, the air pump ambient temperature, and the second correlation characteristic are previously found before the air pump 55 is assembled into the ink jet printer 4, the work loads on the assembly and inspection lines can be lessened and the first correlation characteristic, the air pump ambient temperature, and the second correlation characteristic can be found easily and efficiently.

Next, in the second step, when the pressurized air is produced at the use stage of the ink jet printer 4, a temperature correction based on the air pump ambient temperature detected by the thermistor 82 and the air pump ambient temperature found in the first step is made to the first correlation characteristic and the first correlation characteristic to which the temperature correction is made is used to control the drive motor 50 so that a predetermined air pressure is reached. At this time, the number of revolutions of the drive motor 50 is determined based on the first correlation characteristic to which the temperature correction is made, and the number of revolutions and the second correlation characteristic are used to determine the drive pulse duty ratio.

Next, the first step will be discussed.

Inspection for acquiring characteristic data on the pump module before the pump module including the air pump 55 and the air pump drive motor 50 is built in the ink jet printer 4 will be discussed.

An inspection apparatus for performing the inspection will be discussed. As shown in FIG. 9, a pump module 90 made up of the air pump 55, the drive motor 50, the ejection tube 55*a*, the orifice 61, and the encoder 62 is placed in a predetermined jig (not shown), the thermistor 82 for detecting the ambient temperature of the air pump 55 is attached to the air pump 55, a thermistor 91 for detecting the temperature of the drive motor 50 is attached to the drive motor 50, a tube 92 of a sufficient length is connected to the ejection tube 55*a* of the air pump 55, and a pressure sensor 93 for detecting air pressure is placed at the tip of the tube 92. Further, an inspection control unit 94, an operation panel 95, an LCD (liquid crystal display) 96, and a printer 97 are provided. The encoder 62, the thermistors 82 and 91, and the pressure sensor 93 are connected to the inspection control unit 94. Since the pump module 90 includes at least the air pump 55 and the drive motor 50 integrally as described above, the inspection for acquiring characteristic data can be conducted easily and efficiently and further the pump module 90 can also be easily assembled into the pressurized air supply section 13 of the ink jet printer 4 (pressure production unit), so that the work loads on the assembly and inspection lines can be lessened.

In the ink jet printer 4 of the multifunction apparatus 1, considering that the air supply tube 57 is connected to the air chambers 40*c* to 43*c* of the four ink cartridges 40 to 43, the length of the tube 92 is set to a length on the scale of making it possible to accommodate the air amount almost equal to the maximum value of the total air amount of the air chambers 40*c* to 43*c* of the four ink cartridges 40 to 43. The inspection control unit 94 has a microcomputer, an A/D converter for converting a detection signal of the thermistor 82, 91 into a digital signal, an A/D converter for converting a detection signal of the pressure sensor 93 into a digital signal, a control circuit for controlling the drive motor 50 in the PWM manner, etc., and ROM of the microcomputer stores a control program for performing data detection, computation processing, determination, etc., described below based on flowcharts of FIGS. 10 and 11.

Figure 10:
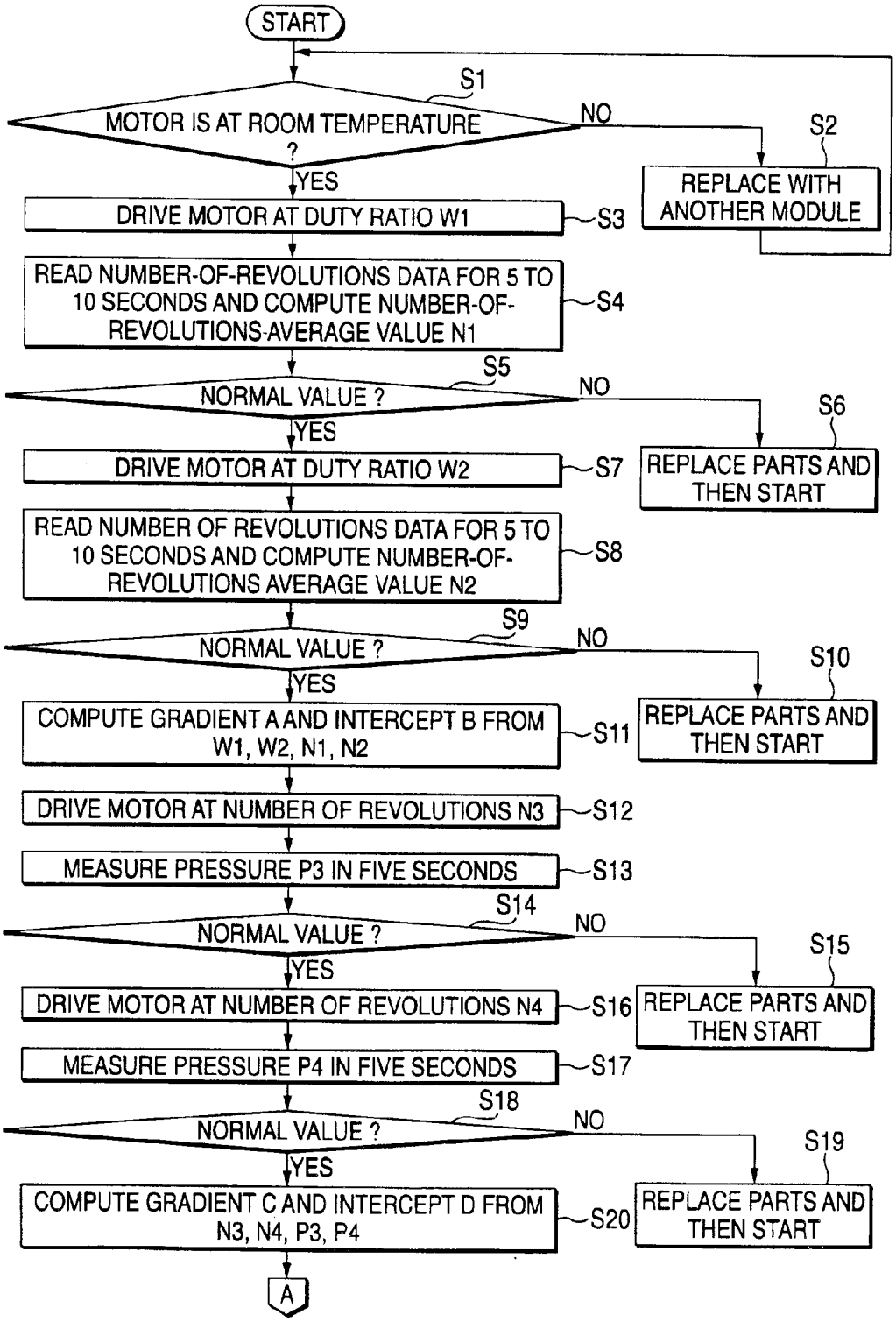
FIG. 10 is a flowchart of a part of control for acquiring correlation characteristic data of each pump module by the inspection apparatus.
Figure 11:
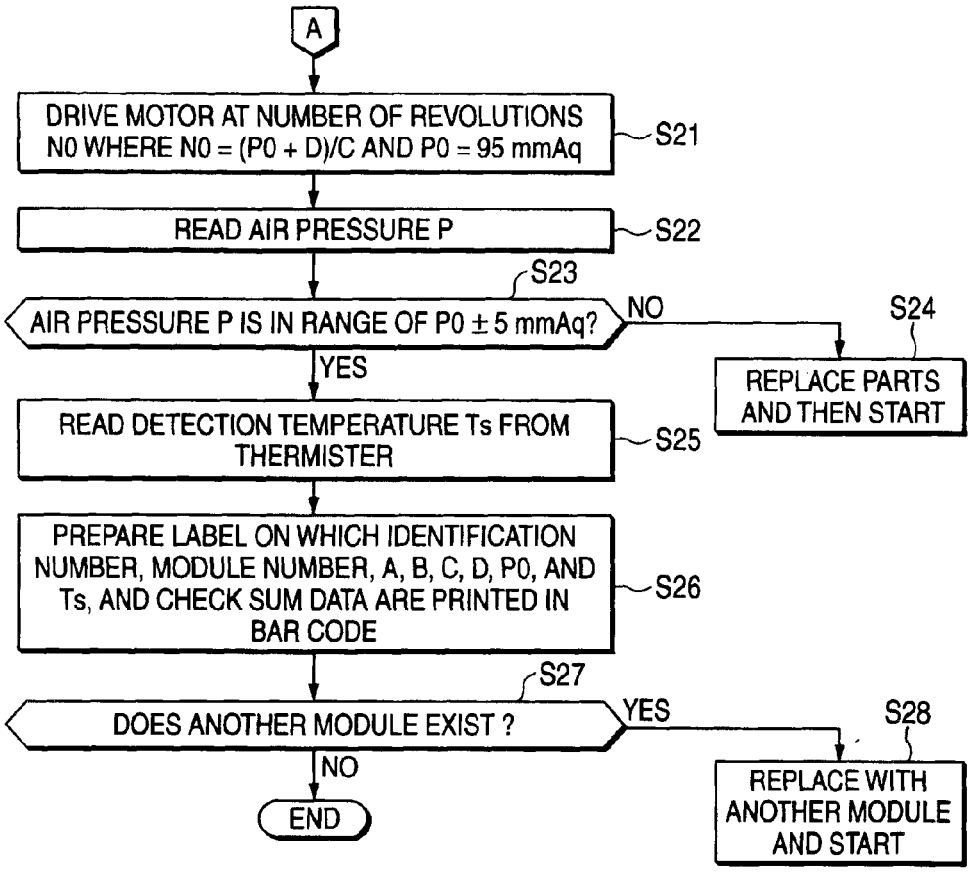
FIG. 11 is a flowchart of the remaining control of FIG. 10.

Next, the first step will be discussed based on the flow charts of FIGS. 10 and 11. Si (i=1, 2, . . . ) in the figures denotes each step.

At S1, whether or not the drive motor 50 is at room temperature is determined based on the detection signal from the thermistor 91. If the determination is NO, a message to the effect that the drive motor 50 is not at room temperature is displayed on the LCD 96 at S2. Then, the operator replaces the pump module with another pump module 90 and operates the operation panel 95 and starts. If the drive motor 50 is at room temperature, at S3, the drive motor 50 is driven at duty ratio W1 and at S4, the number-of-revolutions data for five to 10 seconds is read from the encoder 62 and a number-of-revolutions average value N1 of the collar part 51*a* is computed based on the number-of-revolutions data. In this case, the operation frequency of the air pump 55 is found based on the detection signal from the encoder 62 and is multiplied by 60 to find the number of revolutions of the drive motor 50 (units: rpm).

Next, whether or not the number-of-revolutions average value N1 is a normal value is determined at S5. If the determination is NO, a message to the effect that the average value N1 is not normal is displayed on the LCD 96 at S6. Then, the operator replaces the parts of the drive motor 50, etc., with new parts and then starts. If the number-of-revolutions average value N1 is the normal value, at S7, the drive motor 50 is driven at duty ratio W2 and at S8, the encoder signal for five to 10 seconds is read from the encoder 62 and a number-of-revolutions average value N2 is computed in a similar manner to that described above.

Figure 12:
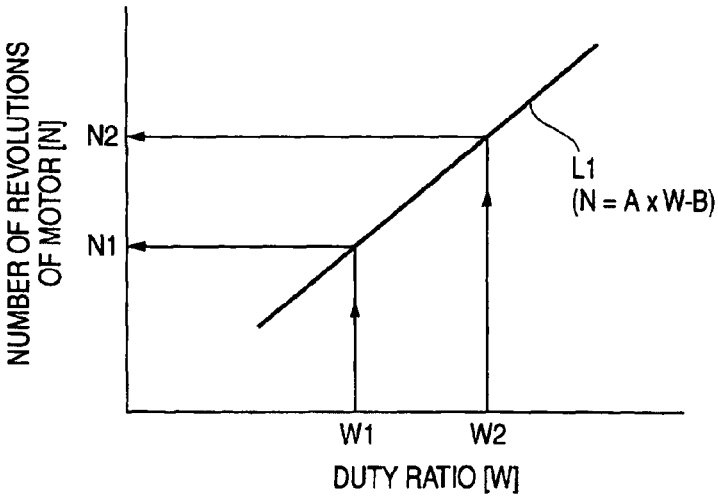
FIG. 12 is a chart to show the correlation characteristic between duty ratio and the number of revolutions of motor.

Next, whether or not the number-of-revolutions average value N2 is a normal value is determined at S9. If the determination is NO, a message to the effect that the average value N2 is not normal is displayed on the LCD 96 at S10. Then, the operator replaces the parts of the drive motor 50, etc., with new parts and then starts. Next, at S11, a characteristic line L1 (corresponding to the second correlation characteristic) shown in FIG. 12 is found from W1, W2, N1, and N2 and a gradient A and an intercept B of the characteristic line L1 are computed and are stored in memory.

Next, the drive motor 50 is driven at the number of revolutions N3 at S12, and air pressure P3 of pressurized air produced in the air pump 55 is measured based on the detection signal from the pressure sensor 93 in five seconds after the drive motor 50 is driven (S13). At S14, whether or not the air pressure P3 is a normal value is determined. If the determination is NO, a message to the effect that the air pressure P3 is not normal is displayed on the LCD 96. Then, the operator replaces the parts of the air pump 55, etc., with new parts and then starts (S15).

Figure 13:
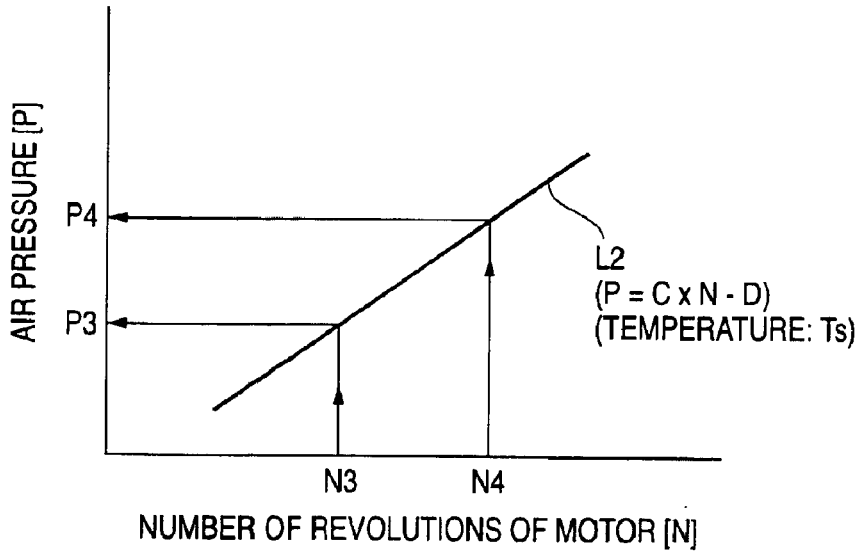
FIG. 13 is a chart to show the correlation characteristic between the number of revolutions of motor and air pressure.

Next, if the air pressure P3 is the normal value at S14, the drive motor 50 is driven at the number of revolutions N4 at S16, and air pressure P4 of pressurized air produced in the air pump 55 is measured based on the detection signal from the pressure sensor 93 in five seconds after the drive motor 50 is driven (S17). At S18, whether or not the air pressure P4 is a normal value is determined. If the determination is NO, a message to the effect that the air pressure P4 is not normal is displayed on the LCD 96. Then, the operator replaces the parts of the air pump 55, etc., with new parts and then starts (S19). Next, at S20, a characteristic line L2 (corresponding to the first correlation characteristic) shown in FIG. 13 is found from N3, N4, P3, and P4 and a gradient C and an intercept D of the characteristic line L2 are computed and are stored in memory.

Next, at S21, the drive motor 50 is driven at the number of revolutions N0. However, P0 is set to 95 mmAq and N0 is set to (P0+D)/C. That is, the number of revolutions N0 is set based on the characteristic line L2 and P0 and the duty ratio is determined based on the characteristic line L1 and N0 and then the drive motor 50 is driven. Next, the detection signal of the pressure sensor 93 is read at S22 and whether or not the detected air pressure P is in the range of (P0±5) mmAq is determined at S23. If the determination is NO, the operator replaces the parts of the air pump 55, etc., with new parts and then starts (S24).

Next, if the determination at S23 is YES, the ambient temperature of the air pump 55 is detected by the thermistor 82 at S25 and detection temperature (a first ambient temperature) Ts is read and is stored in the memory. Next, at S26, the printer 97 is caused to print and prepare a label on which the identification number and the module number entered through the operation panel 95, information representing the characteristic lines L1 and L2 found as described above (A, B, C, D, P0, and Ts), and check sum data for making check sum on the information are printed in bar code. The label is put on the detected pump module 90 temporarily or semi-permanently. At the time, the label may be put on the drive motor 50 or the air pump 55 or may be put on any other part of the pump module 90. To print the label, the identification number and the module number and the information representing the characteristic lines L1 and L2 (A, B, C, D, P0, and Ts) are printed out in a table format separately as text information.

Next, at S27, whether or not another pump module 90 exists is determined. If the determination is YES, a message to the effect that another pump module 90 exists is displayed on the LCD 96. Then, the operator replaces the pump module with another pump module 90 and then starts (S28). If another pump module 90 does not exist, the control is terminated. The first step executed for each pump module 90 is now complete.

The second step executed when pressurized air is produced by the pressurized air supply section when the head face of the print head 23P is wiped by the maintenance mechanism section 11 at the stage of using the ink jet printer 4 of the multifunction apparatus 1 in which the pump module 90 is built will be discussed. The identification number, the module number, and the information representing the characteristic lines L1 and L2 (A, B, C, D, P0, and Ts) printed in bar code on the label prepared in the first step are stored in the RAM 73 of the controller 70 through a barcode reader at the adjustment stage after completion of assembling the multifunction apparatus 1.

Figure 14:
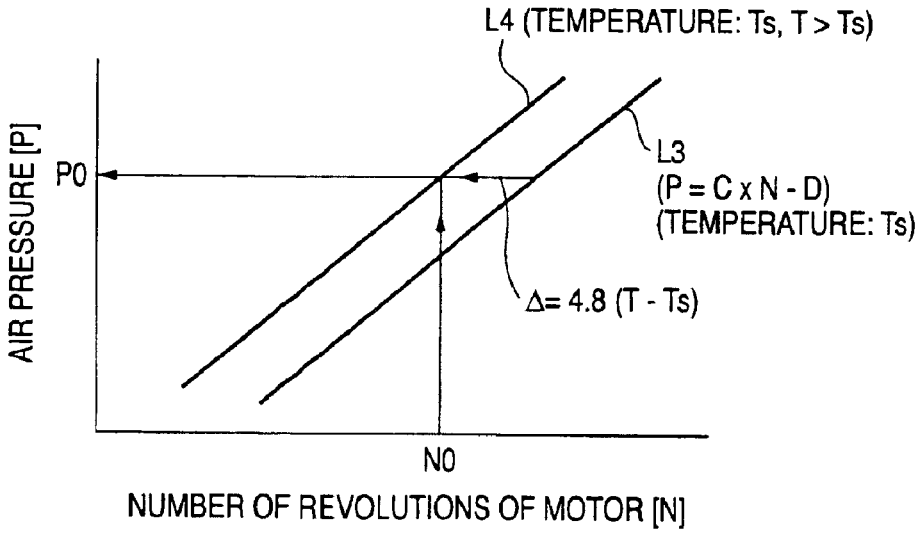
FIG. 14 is a chart to show a correlation characteristic similar to the correlation characteristic in FIG. 13 and correlation characteristic resulting from making temperature correction to that correlation characteristic.
Figure 15:
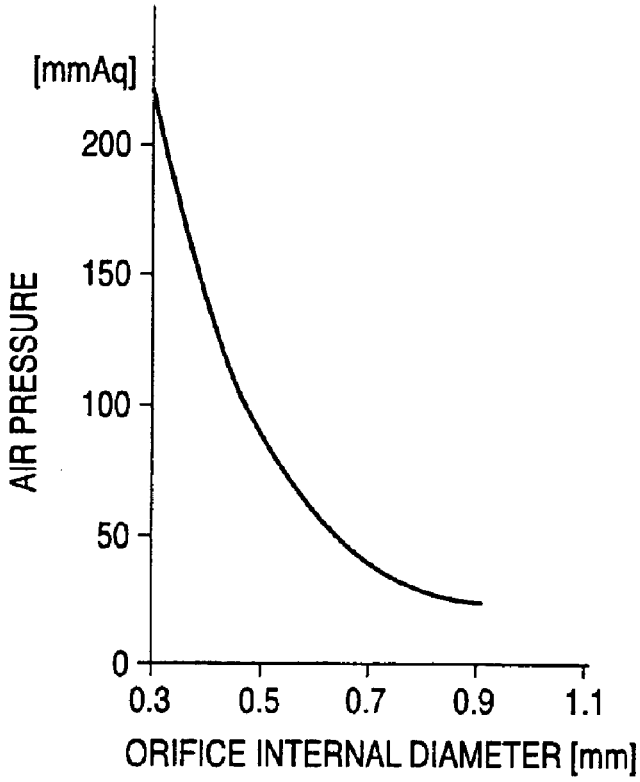
FIG. 15 is a chart to show the correlation characteristic between the orifice internal diameter in a pressurized air supply section and air pressure.

FIG. 14 is a schematic representation to describe the second step. A characteristic line L3 is the same as the characteristic line L2 in FIG. 13 and is a characteristic line indicating the correlation between the number of revolutions of motor N and the air pressure P relative to the ambient temperature Ts of the air pump 55. A characteristic line L4 is a characteristic line provided by parallel moving the characteristic line L3 to the decrease side in the number of revolutions and is a characteristic line relative to ambient temperature (second ambient temperature) T of the air pump 55 detected by the thermistor 82 (where T>Ts). Unlike the viscosity of general liquid, the viscosity of air increases with an increase in the temperature and thus the characteristic provided by making a temperature correction to the characteristic line L3 to which the increase in the ambient temperature of the air pump 55 (T−Ts) is added is the characteristic line L4.

The numeric value of coefficient "4.8" of the temperature correction is previously found by experiment and means that the number of revolutions of motor should be decreased 4.8 rpm each time the temperature increases 1° C. from the ambient temperature Ts. When pressurized air (P0=95 mmAq) is produced to wipe the head face of the print head 23P as described above, assuming that the ambient temperature of the air pump 55 detected by the thermistor 82 is T, if the number of revolutions of motor N0 is found according to calculation expression of N0=(P+D)/C−4.8×(T−Ts), the duty ratio based on the number of revolutions of motor N0 is calculated based on the characteristic line L1 (namely, A and B representing the characteristic line L1), and the drive motor 50 is controlled based on the drive pulse at the duty ratio. The calculation expression can also be applied to the case where T<Ts.

As described above, the number of revolutions of the drive motor 50 is determined based on the first correlation characteristic to which temperature correction is made as described above (characteristic line L4), the number of revolutions and the second correlation characteristic (characteristic line L1) are used to determine the duty ratio of the drive pulse, and the drive motor 50 is driven, whereby pressurized air of almost P0 (for example, P0=95 mmAq) can be produced.

Further, the air pump 55 is the diaphragm pump and vibration of the diaphragm is caused by reciprocation motion. Thus the air pump 55 is set to a sufficiently large capacity of diameter 23 mmϕ and stroke 2 mm. To operate the air pump 55, the number of revolutions of the drive motor is controlled so that the operation frequency of the air pump 55 becomes 20 Hz or less. Since the operation frequency of the air pump 55 becomes 20 Hz or less, if vibration of the diaphragm occurs, its frequency becomes 20 Hz or less and is a frequency less than the audible range of human hearing, so that noise produced in the air pump 55 is suppressed exceptionally.

In the control method of the air pump drive motor of the ink jet printer 4 described above, in the first step, before the pump module 90 is assembled into the ink jet printer 4, it is placed in the inspection apparatus. The first correlation characteristic L2 indicating the correlation characteristic between the number of revolutions of motor N and the air pressure P, the second correlation characteristic L1 indicating the correlation characteristic between the duty ratio W of the drive pulse for driving the drive motor 50 and the number of revolutions of motor N, and the air pump ambient temperature Ts are previously found through the operation of the drive motor 50 and the air pump 55.

Next, in the second step, after the pump module 90 is assembled into the ink jet printer 4, the first correlation characteristic L4 to which temperature correction is made based on the air pump ambient temperature T detected by the thermistor 82 at the use stage of the printer 4 and the air pump ambient temperature Ts at the inspection time is used to determine the number of revolutions of the drive motor 50, N, and the number of revolutions of motor N and the second correlation characteristic L1 are used to determine the duty ratio W of the drive pulse for driving the drive motor 50 and then the drive motor 50 is driven according to the drive pulse of the duty ratio W.

The air pressure is thus controlled using the first correlation characteristic L2 reflecting the manufacturing errors of each air pump 55, drive motor 50, and air pressure adjustment orifice 61, so that an error of the air pressure produced in the air pump 55 can be decreased exceptionally.

Temperature correction is made based on the air pump ambient temperature T detected at the use stage of the printer 4 and the air pump ambient temperature Ts found in the first step, whereby the change in the air pressure caused by change in the outside-air temperature is corrected. Accordingly, an error of the air pressure can be decreased exceptionally when pressurized air to a predetermined air pressure (about 95 mmAq) is produced.

Moreover, since the first step is executed before the air pump 55 is assembled into the printer 4, the work loads on the printer assembly and inspection lines can be lessened, and the first correlation characteristic and the air pump ambient temperature Ts can be found easily and efficiently.

Moreover, the number of revolutions of the drive motor 50, N, is determined based on the first correlation characteristic L4 to which temperature correction is made and the number of revolutions and the second correlation characteristic L1 are used to determine the duty ratio W of the drive pulse, so that the accuracy of control of the number of revolutions of the drive motor 50 can be enhanced and an error of the air pressure when pressurized air to a predetermined air pressure is produced can be decreased exceptionally.

In the first step, the identification number, the module number, the information representing the first and second correlation characteristics L1 and L2 (A to D), and the air pump ambient temperature Ts are printed on a label and the label is put on the pump module 90, so that the information concerning the first and second correlation characteristics and the air pump ambient temperature printed on the label can be input reliably to the controller of the printer at the printer assembly completion stage.

Since the number of revolutions of the drive motor is controlled so that the operation frequency of the air pump becomes 20 Hz or less, most of sound produced from the air pump becomes sound at lower frequencies than the lowest frequency of sound in the audible range of human hearing (20 Hz), so that noise produced from the air pump can be decreased exceptionally.

Modifications of the embodiment of the invention described above will be discussed.

The magnitude of the head H is not limited to the above-mentioned value and the predetermined air pressure produced in the air pump 55 is set in response to the head H. The inner diameter of the orifice 61 (for example, 0.5 mm) is only an example, and may be set to a different inner diameter. If the volume of the air pump 55 or the inner diameter of the orifice 61 is changed, the value of the coefficient "4.8" of the temperature correction (see FIG. 14) must be changed to a different value found by experiment. The structure of the air pump 55 and the drive motor 50 is an example and if a pressurized air supply mechanism of a different structure is adopted, the invention can also be applied in a similar manner. For example, if a pressurized air supply mechanism for adjusting the air pressure by means of a relief valve or a regulator in place of the orifice is adopted, the invention can also be applied in a similar manner.

Figure 16A:
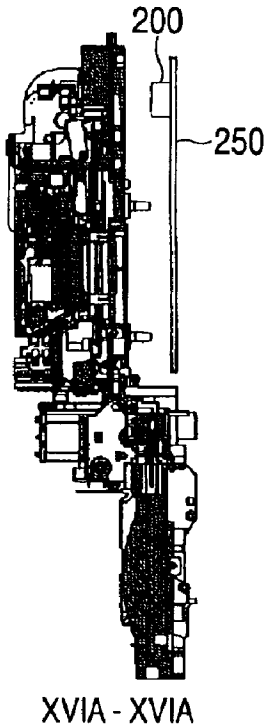
FIGS. 16A and 16B are conceptual drawings when correlation characteristic data is acquired with the pump module assembled into the ink jet printer.
Figure 16B:
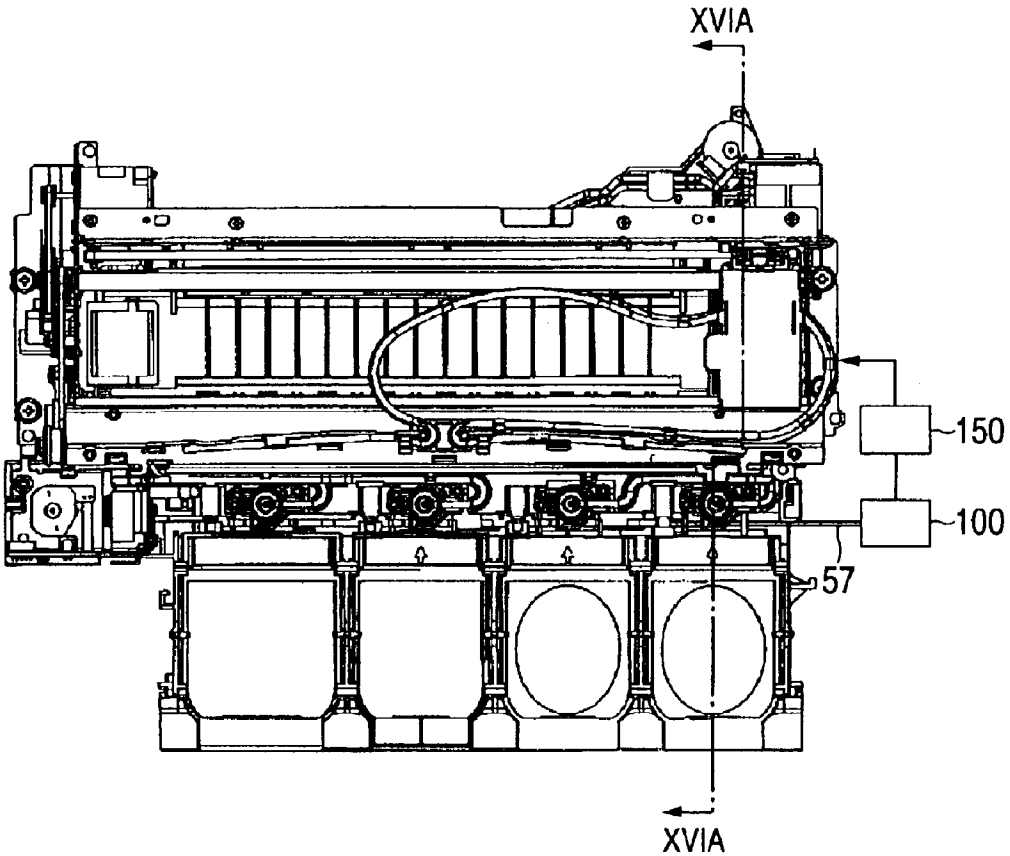

In the embodiment described above, the first correlation characteristic and the air pump ambient temperature Ts when the first correlation characteristic is acquired and further the second correlation characteristic are previously acquired before the pump module is assembled into the ink jet printer 4 (namely, the pressurized air supply section 13 of the pressure production unit), but they may be acquired after the pump module is assembled into the ink jet printer 4. For example, as shown in FIGS. 16A and 16B, the air supply tube 57 extended from the pump module assembled into the ink jet printer 4 is connected to a pressure gauge 100 for measurement, and the first correlation characteristic, the air pump ambient temperature Ts, and the second correlation characteristic when the air pump 55 is driven under a predetermined condition may be acquired. In this case, the pressure gauge 100 is connected to a personal computer (PC) 150 and further the PC 150 is connected to EEPROM 200 on a board 250, for example, and thus the first correlation characteristic, the air pump ambient temperature Ts, and the second correlation characteristic acquired are previously stored in the EEPROM 200.

In the embodiment described above, the EEPROM 200 is not shown in the block diagram of FIG. 8. However, to acquire the first correlation characteristic, the ambient temperature Ts, and the second correlation characteristic after the pump module is assembled into the ink jet printer 4, additional EEPROM 200 may be provided. After the pressure gauge 100 is removed from the air supply tube 57, the opening end may be closed with a plug, etc., (not shown).

The shape and the driving source of the air pump 55 are not limited to those described in the above embodiment. In the above embodiment, the air pump 55 is a motor pump that is driven by the drive motor 50. However, the air pump 55 maybe a solenoid pump using a solenoid as a drive source, an ultrasonic pump using an ultrasonic transducer, a reciprocal pump, a rotary pump, or the like.

The invention can be embodied in various modifications of the specific embodiment without departing from the spirit and the scope of the invention.

According to the embodiment, an error of the air pressure caused by the manufacturing error of the air pump 55 and the drive motor 50 can be decreased exceptionally. The orifice 61 is formed in the pressurized air supply channel for supplying pressurized air from the air pump 55 driven by the drive motor 50, as the air pump ambient temperature T (namely, outside-air temperature) becomes high, the viscosity of air increases and the air pressure adjusted in the orifice 61 increases. Then, the temperature correction is made as described above, whereby the change in the air pressure caused by change in the outside-air temperature is corrected and an error of the air pressure when pressurized air to a predetermined air pressure is produced can be decreased exceptionally.

According to the embodiment, the accuracy of control of the number of revolutions of the drive motor 50 can be enhanced and an error of the air pressure when pressurized air to a predetermined air pressure is produced can be decreased exceptionally.

According to the embodiment, the work loads on the assembly and inspection lines can be lessened and the second correlation characteristic can be found easily and efficiently.

According to the embodiment, the workloads on the assembly and inspection lines can be lessened and the first correlation characteristic and the ambient temperature Ts can be found easily and efficiently.

According to the embodiment, most of sound produced from the air pump 55 becomes sound at lower frequencies than the lowest frequency of sound in the audible range of human hearing (20 Hz), so that noise produced from the air pump 55 can be decreased exceptionally.

According to the embodiment, there can be provided a pump module which is also easily assembled into the pressurized air supply section 13 and makes it possible to lessen the work loads on the assembly and inspection lines and further find the correlation characteristic and the ambient temperature easily and efficiently.

According to the embodiments there can be provided an ink jet printer 4 wherein the air pressure can be controlled in such a manner that the effect of manufacturing errors of each of the pressurized air supply section 13 is added and further can be controlled in such a manner that the effect of the outside-air temperature at the printing time is added.

According to the embodiment, at the use stage of the pressurized air supply section 13, a temperature correction is made based on the current air pump ambient temperature T detected by the thermistor 82 and the air pump ambient temperature Ts found in the first step, whereby the change in the air pressure caused by change in the outside-air temperature is corrected and an error of the air pressure when pressurized air to a predetermined air pressure is produced can be decreased exceptionally.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A pressure production unit, comprising:

an air pump unit that produces pressurized air;

a drive source that drives the air pump unit;

a storage unit that stores a first correlation characteristic and a first ambient temperature, the first correlation characteristic indicating correlation between a drive frequency of the drive source and an air pressure of pressurized air produced in the air pump unit, the first ambient temperature indicating an ambient temperature of the air pump unit when the first correlation characteristic is acquired;

a temperature sensing unit that senses ambient temperature of the air pump unit; and a control unit configured to set the ambient temperature sensed by the temperature sensing unit as a second ambient temperature, to make a correction to the first correlation characteristic according to the first and second ambient temperatures, and to control the drive source on a basis of the corrected first correlation characteristic so that a predetermined air pressure is produced.

2. The pressure production unit as claimed in claim 1, wherein the storage unit stores a second correlation characteristic indicating a correlation between duty ratio of a drive pulse for driving the drive source and the drive frequency of the drive source; and the control unit is configured to determine the drive frequency of the drive source on the basis of the corrected first correlation characteristic, and to determine the duty ratio according to the drive frequency of the drive source and the second correlation characteristic.

3. The pressure production unit as claimed in claim 2, wherein the second correlation characteristic is acquired before the air pump and the drive source are assembled into the pressure production unit.

4. The pressure production unit as claimed in claim 1, wherein the first correlation characteristic and the first ambient temperature are acquired before the air pump and the drive source are assembled into the pressure production unit.

5. The pressure production unit as claimed in claim 1, wherein the air pump unit includes a diaphragm pump; and the control unit controls the drive frequency of the drive source so that an operation frequency of the diaphragm pump becomes less than an audible range of human hearing.

6. The pressure production unit as claimed in claim 5, wherein the control unit controls the drive frequency of the drive source so that the operation frequency of the diaphragm pump becomes 20 Hz or less.

7. The pressure production unit as claimed in claim 1, wherein the air pump unit and the drive source make up an integral pump module.

8. The pressure production unit as claimed in claim 1, wherein the air pump unit includes an air pump, an ejection tube communicated with the air pump and an orifice that communicates the ejection tube with atmosphere.

9. An ink jet printer, comprising:

an ink cartridge that stores ink;

a record head which selectively ejects the ink supplied from the ink cartridge onto a record medium;

an air pump unit that produces pressurized air to be supplied to the ink cartridge to pressurize the ink;

a drive source that drives the air pump unit;

a storage unit that stores a first correlation characteristic and a first ambient temperature, the first correlation characteristic indicating correlation between a drive frequency of the drive source and an air pressure of pressurized air produced in the air pump unit, the first ambient temperature indicating an ambient temperature of the air pump unit when the first correlation characteristic is acquired;

a temperature sensing unit that senses ambient temperature of the air pump unit; and a control unit configured to set the ambient temperature sensed by the temperature sensing unit as a second ambient temperature, to make a correction to the first correlation characteristic according to the first and second ambient temperatures, and to control the drive source on a basis of the corrected first correlation characteristic so that a predetermined air pressure is produced.

10. The ink jet printer as claimed in claim 9, wherein the storage unit stores a second correlation characteristic indicating a correlation between duty ratio of a drive pulse for driving the drive source and the drive frequency of the drive source; and the control unit is configured to determine the drive frequency of the drive source on the basis of the corrected first correlation characteristic, and to determine the duty ratio according to the drive frequency of the drive source and the second correlation characteristic.

11. The ink jet printer as claimed in claim 9, wherein the air pump unit includes an air pump, an ejection tube that communicates the air pump with the ink cartridge and an orifice that communicates the ejection tube with the atmosphere.

12. A control method of a drive source for driving an air pump unit to produce pressurized air in a pressure production unit, the control method comprising the steps of:

finding a first correlation characteristic indicating correlation between a drive frequency of the drive source and an air pressure of pressurized air produced in the air pump unit;

finding a first ambient temperature, the first ambient temperature indicating an ambient temperature of the air pump unit when the first correlation characteristic is acquired;

sensing a second ambient temperature, the second ambient temperature indicating a current ambient temperature of the air pump unit;

correcting the first correlation characteristic based on the first and second ambient temperatures; and controlling the drive source on a basis of the corrected first correlation characteristic so that a predetermined air pressure is produced.

13. The control method as claimed in claim 12, further comprising:

finding a second correlation characteristic indicating correlation between a duty ratio of a drive pulse for driving the drive source and drive frequency of the drive source;

wherein the controlling step includes: determining the drive frequency of the drive source based on the corrected first correlation characteristic; and determining the duty ratio of the drive pulse based on the drive frequency and the second correlation characteristic.

14. The control method as claimed in claim 13, wherein the second correlation characteristic is acquired before the air pump unit and the drive source are assembled into the pressure production unit.

15. The control method as claimed in claims 12, wherein the step of finding the first correlation characteristic is executed before the air pump unit and the drive source are assembled into the pressure production unit.

16. The control method as claimed in claim 12, wherein, in the controlling step, the drive frequency of the drive source is controlled so that an operation frequency of the air pump unit becomes less than an audible range of human hearing.

17. The control method as claimed in claim 16, wherein, in the controlling step, the drive frequency of the drive source is controlled so that the operation frequency of the air pump unit becomes 20 Hz or less.

18. The control method as claimed in claim 12, wherein the step of finding the first correlation characteristic is executed in a state that the air pump and the drive source are integrated.

19. A control method of a drive source for driving an air pump unit in an ink jet printer, wherein the ink jet printer includes an ink cartridge that stores ink, and a record head which selectively ejects the ink supplied from the ink cartridge onto a record medium; and the air pump unit produces pressurized air to pressure the ink in the ink cartridge; the control method comprising the steps of:

finding a first correlation characteristic indicating correlation between a drive frequency of the drive source and an air pressure of pressurized air produced in the air pump unit;

finding a first ambient temperature, the first ambient temperature indicating an ambient temperature of the pump unit when the first correlation characteristic is acquired;

sensing a second ambient temperature, the second ambient temperature indicating a current ambient temperature of the pump unit;

correcting the first correlation characteristic based on the first and second ambient temperatures; and controlling the drive source on the basis of the corrected first correlation characteristic so that a predetermined air pressure is produced.

20. A pressure production unit, comprising:

an air pump unit for producing pressurized air;

a drive source for driving the air pump unit;

storing means for storing a first correlation characteristic and a first ambient temperature, the first correlation characteristic indicating correlation between a drive frequency of the drive source and an air pressure of the pressurized air produced in the air pump unit, the first ambient temperature indicating an ambient temperature of the pump unit when the first correlation characteristic is acquired;

sensing means for sensing a second ambient temperature, the second ambient temperature indicating a current ambient temperature of the pump unit;

correcting means for correcting the first correlation characteristic based on the first and second ambient temperatures; and controlling means for controlling the drive source on a basis of the corrected first correlation characteristic so that a predetermined air pressure is produced.

* * * * *